United States Patent [19]

Nix

[11] 3,967,696

[45] July 6, 1976

[54] STAGE SAFETY STABILIZER

[76] Inventor: Donald James Nix, P.O. Box 60396, Oklahoma City, Okla. 73106

[22] Filed: July 8, 1974

[21] Appl. No.: 462,316

[52] U.S. Cl. ..... 182/142; 182/112

[51] Int. Cl.[2] ..... E04G 3/10

[58] Field of Search ..... 182/142, 143, 144, 145, 182/150, 112, 113, 222, 223

[56] References Cited

UNITED STATES PATENTS

| | | | |
|---|---|---|---|
| 177,477 | 5/1876 | Crockett | 182/142 |
| 371,585 | 10/1887 | Holdridge | 182/193 |
| 1,919,016 | 7/1933 | Geer | 182/143 |
| 2,435,969 | 2/1948 | Lackner | 182/112 |
| 2,689,890 | 9/1954 | Green | 182/112 |
| 3,630,315 | 12/1971 | Meyer | 182/142 |

FOREIGN PATENTS OR APPLICATIONS

| | | | |
|---|---|---|---|
| 771,182 | 7/1934 | France | 182/150 |

*Primary Examiner*—Reinaldo P. Machado
*Attorney, Agent, or Firm*—Robert K. Rhea

[57] ABSTRACT

A stage stabilization device comprising vertically disposed telescoping pipes forming a davit adapted to be connected to a stage. Three grooved periphery wheels, connected with the davit, form a releasable stabilizing connection between the davit and stage supporting cable.

1 Claim, 4 Drawing Figures

STAGE SAFETY STABILIZER

FIELD OF THE INVENTION

This invention relates to scaffolds and is adapted to be used on stage platforms usually supporting two workmen and always supported by two cables.

DESCRIPTION OF THE PRIOR ART

A cable supported stage is always unstable under the best of conditions and prior attempts to stabilize such stages has, in some instances, resulted in mechanical devices which require more labor and time for installation and operation and a resulting cost which is greater than the original job bid. Most contractors do not use stabilization methods at this time on cable suspended staging except fixing them firmly to the wall in some manner, when weather conditions are bad and work can be performed otherwise.

This stabilizer is light, portable, interchangable from stage to stage, economical and requires only minutes to attach or remove.

SUMMARY OF THE INVENTION

A vertically disposed tubular member is adapted to be connected at its depending end portion with a scaffold or stage. The stage connected tubular member telescopically receives an upper tubular member within its upper end portion. The upper end portion of the upper tubular member is arcuately curved to form a davit projecting laterally of the axis of the telescoping tubes in overlying spaced relation with respect to the stage. A plate is connected with the upper end portion of the davit forming tubular member and three wheels, each having a grooved periphery, are connected with one surface of the plate to form a vertical guide path for a stage supporting cable and preventing separation of the cable from the grooved wheels when the cable is taut. The spacing between the wheels on the plate permits manual insertion and removal of the cable when the stage is resting on the surfae of the earth and the cable is in a slackened condition.

The principal object of this invention is to provide a stage stabilizing device which can easily be attached to and removed from a stage with a minimum of tools, is of relatively lightweight, is portable and stabilizes a stage by a rolling contact with the stage support cable when supporting workmen performing work on a building or wall.

DESCRIPTION OF THE PREFERRED EMBODIMENT

Figure 1:
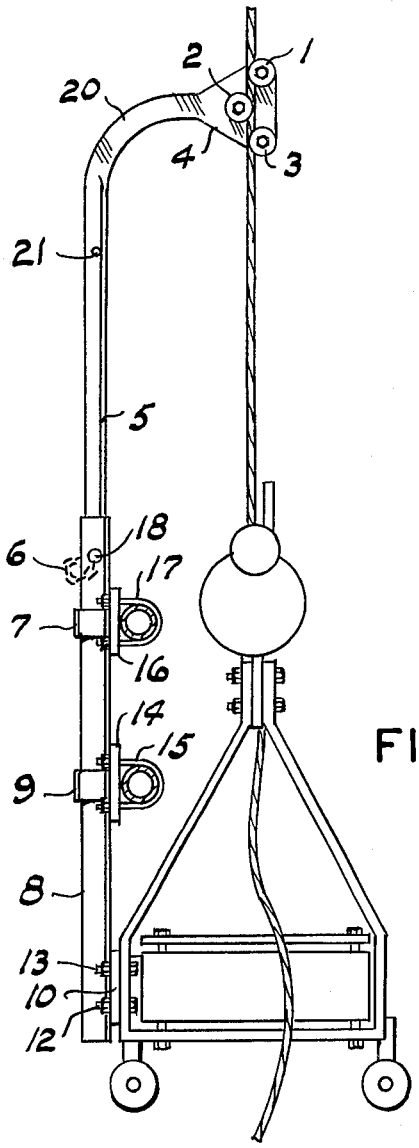
FIG. 1 is an elevational view illustrating the device when connected with a cable supported stage.
Figure 2:
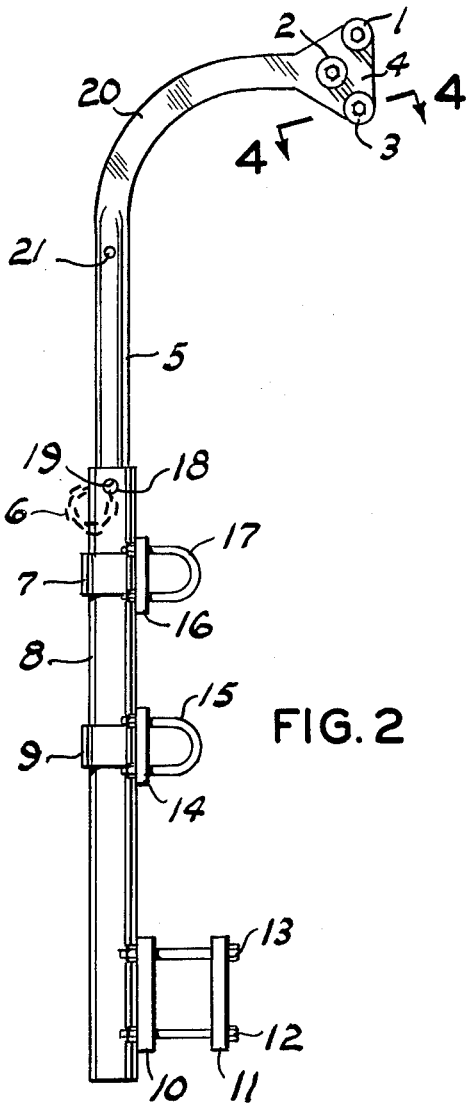
FIG. 2 is an elevational view, to a larger scale, of the device, per se.
Figure 3:
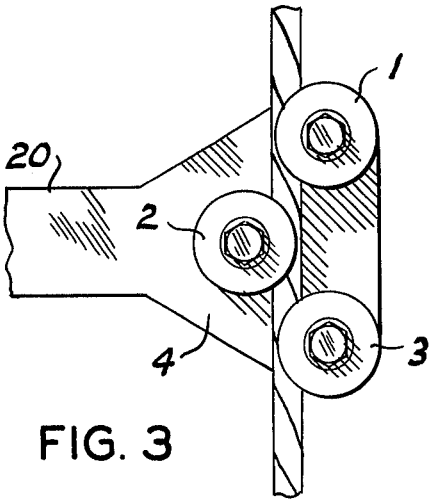
FIG. 3 is a fragmentary elevational view, to a further enlarged scale, illustrating the relative position of the grooved wheels when engaging a stage supporting cable; and, FIG. 4 is a horizontal cross sectional view, to a different scale, taken substantially along the line 4—4 of FIG. 2.
Figure 4:
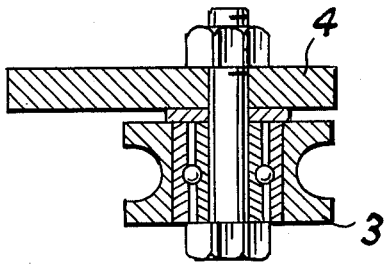

Like characters of reference designate like parts in those figures of the drawings in which they occur.

In the drawings:

An elongated vertically disposed tubular member, such as a pipe 8, is rigidly connected at its depending end portion with a plate 10 having bolt receiving apertures adjacent its respective corner for receiving four bolts 12 and 13, only two being shown. The bolts 12 and 13 project through apertures formed in the respective corner of an identical plate 11 to form a clamping means for connecting the pipe 8 to one side of a platform or stage. Intermediate its ends, a pair of collar-like vertically spaced sections of pipe 7 and 9 vertically slidably surround the pipe 8. Each of the sections 7 and 9 have a square section of steel plate 16 and 14, respectively, welded thereto. Each of the plates 14 and 16 are provided with apertures adjacent their respective corner for receiving U-bolts 15 and 17, respectively, for surrounding rails forming a part of the stage and maintaining the axis of the pipe 8 vertical. The sections 7 and 9, being moveable along the pipe 8, compensate for any variation in spacing of stage back rail placement.

An upper elongated tubular member, such as a pipe 5, has its depending end portion telescopically received by the pipe 8. The pipes 8 and 5 are transversely bored to form an aperture 19 for receiving a pin 18 and maintaining the desired telescoped position of the pipe 5 with respect to the pipe 8. A chain 6, or the like, connects the pin 18 with the pipe 8. The pipe 5 is provided, intermediate its ends, with at least one additional aperture 21 for similarly receiving the pin 18 and maintaining the pipe 5 telescoped into the pipe 8. The upper end portion 20 of the pipe 5 is flatened and arcuately curved laterally to form a davit overhanging the stage. The laterally projecting end of the upper pipe portion 20 is connected, as by welding, to one corner portion of an equalateral triangular-shaped plate 4 with the plane of the plate being parallel with the vertical axes of the pipes 5 and 8.

A pair of rollers 1 and 3, each having a grooved periphery are secured on horizontal axes to one face of the plate 4, in vertical spaced relation, adjacent the respective other corner portions of the triangular-shaped plate 4, these corner portions of the plate 4 being arcuately curved complemental with the radius of the wheels 1 and 3. A third identical wheel 2, having a grooved periphery, is cooperatively secured on a horizontal axis to the same face of the plate 4 in off-set relation toward the vertical axis of the pipe 5 a distance sufficient to permit lateral movement of a stage support cable between confronting arcs of the peripheries of the wheels at their closest approach to each other and to form a vertical guide path, by the grooves in the wheels, for a cable normally supporting a stage. The radius of the grooves in the peripheries of the wheels 1, 2 and 3 is substantially equal with the radius of the stage support cable. The cable guide path formed by the wheel grooves contacts the cable to produce a rolling action of the wheels along the cable when the cable is moved relative to the davit. The spacing between the wheel 2 and wheels 1 and 3 is such that a cable, when in slackened condition, may be manually bent and easily inserted into the vertical guide path formed by the grooved peripheries of the wheels.

Obviously the invention susceptible to changes or alterations without defeating its practicability. Therefore, I do not wish to be confined to the preferred embodiment shown in the drawings and described herein.

I claim:

1. A stabilizer for a cable suspended platform of the type in which vertical movement of the platform is achieved by winding and unwinding an intermediate portion of the cable on a reel mounted on the platform, comprising:

a vertically adjustable davit having a generally vertical depending end portion and having its upper off-set end portion flattened and lying in a vertical plane;

clamp means for connecting the depending end portion of said davit with a lateral surface of the platform;

upper and lower wheels journalled on horizontal axes in vertical spaced relation adjacent the end limit of the off-set end portion of said davit remote from the vertical axis of its depending end portion; and, an intermediate wheel journalled on a horizontal axis by the offset end portion of said davit intermediate the vertical spacing between said upper and lower wheels and spaced laterally thereof toward the vertical axis of the depending end portion a distance sufficient to permit lateral movement of the platform suspension cable, when in a slackened condition, between confronting arcs of the peripheries of said wheels at their closest approach to each other, said wheels each having a grooved periphery with the radius of the groove being substantially the same as the radius of the platform suspending cable, whereby the grooves of said wheels are cooperatively aligned to define a generally vertical substantially circular, in transverse section, guide path diametrically not greater than the diameter of the platform suspension cable so that a platform raising and lowering action moves said wheels in a rolling action along the cable.

* * * * *